United States Patent [19]

Greinacher

[11] 4,139,427

[45] Feb. 13, 1979

[54] EUROPIUM CHLORIDE ENRICHMENT PROCESS

[75] Inventor: Ekkehard Greinacher, Essen, Fed. Rep. of Germany

[73] Assignee: Th. Goldschmidt AG, Fed. Rep. of Germany

[21] Appl. No.: 831,759

[22] Filed: Sep. 9, 1977

[51] Int. Cl.² ..... C25C 3/00
[52] U.S. Cl. ..... 204/64 R
[58] Field of Search ..... 204/64 R

[56] References Cited

U.S. PATENT DOCUMENTS

| | | | |
|---|---|---|---|
| 2,961,387 | 11/1960 | Slaten | 204/64 R |
| 3,062,727 | 11/1962 | Pokorny | 204/64 R |
| 3,729,397 | 4/1973 | Goldsmith et al. | 204/64 R |

*Primary Examiner*—Howard S. Williams
*Attorney, Agent, or Firm*—James E. Bryan

[57] ABSTRACT

This invention relates to a process for europium chloride enrichment in the residual salts obtained from the fusion electrolysis of water-free rare earth halides, which comprises electrolyzing a melt of rare earth halides which contains at least 4% by weight of fluorides in the form of alkali fluorides, alkaline earth fluorides and/or rare earth fluorides.

2 Claims, No Drawings

EUROPIUM CHLORIDE ENRICHMENT PROCESS

The invention relates to a process for europium chloride enrichment in the residual salts obtained in the fusion electrolysis of water-free rare earth halides.

As a rule, the rare earths are divided into the so-called cerite earths and the yttrium earths. Europium, among the cerite earths, in recent years has gained special significance as an activator in fluorescent materials and as a neutron-captor in the control elements of nuclear reactors.

Bastnaesite, monazite sand and britholite in particular are known as ores of the rare earths. Concentrates containing rare earths furthermore are obtained in the recovery of certain fluorine-containing apatites mined at Kola (USSR).

However, europium is contained in such ores only in minute amounts. First, there must be europium enrichment before there can be extraction of europium and of compounds thereof.

This is the object of the present invention. It relates in particular to europium enrichment in the so-called residual salts obtained in the fusion electrolysis of water-free rare earth halides.

The water-free halides of the rare earths may be prepared in known manner, in instance as described in German Pat. No. 891,251, by reacting the ores of the rare earths in a reaction vessel at temperatures of about 900–1,000° C. with chlorine and carbon. The water-free chloride formed collects at the bottom of the reactor and is tapped from time to time.

Thereupon, the water-free mixture of the chlorides of the rare earths may be electrolyzed in the fused state in ceramic or iron or graphite cells. In this process, a misch metal is deposited at the cathode and is composed of about half of cerite and of about 39–46% by weight of lanthanum, neodymium, and praseodymium. Cerite and praseodymium preferentially separate; neodymium is still separated fairly well. In the course of the electrolysis, samarium is enriched in the melt. After completion of the electrolysis, there remains a so-called residual salt containing most of the samarium and other salts which separate poorly or not at all.

Europium assumes a special role. Examining the process, one finds there is no europium, or only very little in the misch metal. It is to be expected, therefore, that it should enrich the residual salt, as is the case for samarium. However, this was not ascertained. Therefore, it must be assumed that europium escapes in the form of its sub-chloride together with the anodically formed chlorine, even though so far this has not been definitively established.

Surprisingly, it was found that it is possible to achieve europium enrichment in the form of the chloride in the residual salt provided the water-free fused salt of the rare earth halides contains at least 4% by weight of fluoride in the form of alkali-, alkaline earth, and/or rare earth fluorides.

In order to achieve the maximum possible enrichment in europium in the residual salt, the electrolysis preferably is carried out until the fluoride content of the melt is sufficiently high that continuation of the electrolysis would become uneconomical because of increasing power consumption of excessive rise of the melting point of the salt to be electrolyzed. Therefore, and especially on economical grounds, a maximum content of 50% by weight of fluorides in the melt should not be exceeded in the electrolysis. In practice, electrolysis should be terminated when a fluoride content of about 20% by weight has been attained in the salt melt.

The process of the invention surprisingly succeeds in enriching the europium in the form of the water-soluble, europium chloride to about 95% by weight of the initial amount in the residual salt. This means that, depending upon the initial amounts of the rare earth ores and the halides prepared therefrom, approximately as much as 1 to 2% by weight of $EuCl_2$ may be contained in the residual salt.

The process of the invention offers multifold advantages. For instance, it is possible to use directly the rare earth concentrates obtained in the recovery of the fluoro-apatites, without being required to remove the entire amount of the fluoride present. The same applies to the britholite mineral. Again, fluorides containing bastnaesite following conversion into water-free halides may be used without requiring separation from fluoride impurities. A second advantage of the process is that the europium is contained in the form of water-soluble, eruopium chloride in the residual salt and as such is preferentially dissolved when being washed with water, whereby there is further enrichment in europium. the europium can be further enriched from such an eluate in known manner, for instance the liquid-liquid distribution process, and finally it can be obtained in very pure form.

It was already known to add minor amounts of fluorides to the water-free chlorides in the course of the fusion electrolysis. However, the amounts of fluorides added were too small to achieve the effect of the process of the invention. The expert conversant with the state of the art was motivated - contrary to the teachings of the process of the invention - to maintain the fluoride content as low as possible in the melt, because the amount of the residual salt depends upon that of the fluorides used and larger amounts of fluorides will decrease the yield of misch metal. Therefore, just that amount of fluoride is selected, which achieves the desired liquefaction of the melt, i.e., which obtains the appropriate lowering of the melting point. Beyond that, it was not known to extract europium from the residual salts of the fusion electrolysis by treating the residual salt with water.

The invention will be further illustrated by reference to the following specific example:

EXAMPLE

Electrolysis is carried out with a fused salt bath composed of 850 kg of $RECl_3$, 100 kg of $REF_3$, and 50 kg of alkaline earth chloride/fluoride. RE means a mixture of rare earths. The 850 kg of rare earth chlorides are composed of 257 kg of $LaCl_3$
423 kg of $CeCl_3$
30 kg of $PrCl_3$
105 kg of $NdCl_3$
7 kg of $SmCl_3$
1 kg of $EuCl_3$, and
27 kg of chlorides of other rare earths.

The 100 kg of $REF_3$ are composed of
30.0 kg of $LaF_3$
50.0 kg of $CeF_3$ 4.0 kg of $PrF_3$
12.0 kg of $NdF_3$
1.0 kg of $SmF_3$
0.1 kg of $EuF_3$ and
2.9 kg of fluorides of other rare earths.

The fused salt bath is electrolyzed at a temperature of 950° C. for 10 hours at a potential of 7.5 volts and a current of 40,000 amperes in an iron crucible acting as a cathode and with graphite rods acting as an anode dipping into the bath. Then, the electrolysis is terminated. The electrolysis resulted in a mixture of 420 kg of metal of rare earths and 246 kg of so-called residual salts. The mixture of metal rare earths, which is designated as cerite misch metal, is composed of
116 kg of La
223 kg of Ce
15 kg of Pr
52 kg of Nd and
14 kg of metals of other rare earths.

It contains practically no samarium metal or europium metal.

The 246 kg of residual salt obtained are composed of 117.9 kg of rare earth chlorides, 90 kg of rare earth chloride-fluoride. and of 38.1 kg of alkaline earth chlride-fluoride.

The rare earth chlorides are of the following composition:
43.00 kg of $LaCl_3$
46.00 kg of $CeCl_3$
4.30 kg of $PrCl_3$
14.00 kg of $NdCl_3$
6.30 kg of $SmCl_2$
0.95 kg of $EuCl_2$, and
3.30 kg of the chlorides of other rare earths.

The 90 kg of rare earth fluorides are of the following composition:
35.00 kg of $LaF_3$
37.00 kg of $CeF_3$
3.30 kg of $PrF_3$
12.00 kg of $NdF_3$, and
2.70 kg of the fluorides of other rare earths.

Practically no fluorides of samarium and europium can be found. Thus the europium enrichment that took place was a factor of 4. Further enrichment can be achieved during subsequent elution.

It will be obvious to those skilled in the art that many modifications may be made within the scope of the present invention without departing from the spirit thereof, and the invention includes all such modifications.

What is claimed is:

1. In the process of electrolyzing a fused mixture of rare earth chlorides in which misch metal and non-electrolyzed resiudual salts are obtained,
the improvement comprising electrolyzing a melt of rare earth chlorides which contains at least 4% by weight of fluorides in the form of alkali fluorides, alkaline earth fluorides and/or rare earth fluorides, whereby europium chloride is enriched in said residual salts in the form of water-extractable europium-II-chloride.

2. A process as defined in claim 1 in which the electrolysis is continued up to a maximum content of 50% by weight of fluorides in the melt.

* * * * *